US005202728A

United States Patent [19]

Maeshima et al.

[11] Patent Number: 5,202,728

[45] Date of Patent: Apr. 13, 1993

[54] IMAGE-FORMING MACHINE WITH IMPROVED DEVELOPER AGITATING MEANS, DEVELOPER REGULATING BLADE MEANS, CLEANING DEVICE, AND TONER RECOVERY SYSTEM

[75] Inventors: Masanobu Maeshima, Sakai; Hiroyuki Maede, Otsu; Toshihiro Sato, Neyagawa; Masao Otsuka, Ashiya; Hiroaki Tsuchiya, Nishinomiya; Shigeo Koyama, Ibaraki; Eiji Tsutsui, Amagasaki, all of Japan

[73] Assignee: Mita Industrial Co., Ltd., Japan

[21] Appl. No.: 346,543

[22] Filed: May 2, 1989

[30] Foreign Application Priority Data

May 9, 1988 [JP] Japan ..... 63-110362
May 9, 1988 [JP] Japan ..... 63-112036

[51] Int. Cl.[5] ..... G03G 15/08; G03G 21/00

[52] U.S. Cl. ..... 355/245; 355/298; 355/299

[58] Field of Search ..... 355/210, 225, 245, 260, 355/298, 299; 250/324

[56] References Cited

U.S. PATENT DOCUMENTS

| | | | |
|---|---|---|---|
| 4,108,658 | 8/1978 | Koeleman et al. | 355/246 X |
| 4,456,364 | 6/1984 | Hatzis | 355/260 |
| 4,468,111 | 8/1984 | Yamagata et al. | 355/260 X |
| 4,538,898 | 9/1985 | Kanno et al. | 355/253 X |
| 4,609,276 | 9/1986 | Mitzutani | 355/210 |
| 4,659,212 | 4/1987 | Ichihara et al. | 355/298 |
| 4,668,074 | 5/1987 | Hirozane | 355/245 X |
| 4,708,455 | 11/1987 | Kubota et al. | 355/260 X |
| 4,792,680 | 12/1988 | Lang et al. | 355/225 X |
| 4,876,574 | 10/1989 | Tajima et al. | 355/245 X |
| 4,920,916 | 5/1990 | Mizuno et al. | 355/245 X |
| 4,974,020 | 11/1990 | Takamatsu et al. | 355/299 X |

FOREIGN PATENT DOCUMENTS

| | | | |
|---|---|---|---|
| 55-96974 | 7/1980 | Japan | 355/298 |
| 61-50179 | 3/1986 | Japan | 355/298 |
| 63-56678 | 3/1988 | Japan | 355/298 |

*Primary Examiner*—Fred L. Braun
*Attorney, Agent, or Firm*—Beveridge, DeGrandi & Weilacher

[57] ABSTRACT

An image-forming machine includes a detachably mountable process unit. The process unit has a rotatable drum having an electrostatographic material thereon, a corona discharger, a developing device and a cleaning device. The developing device includes a development housing for holding a developer, a developer applicator for applying the developer to the electrostatographic material, and an agitating device for stirring the developer in the development housing. An agitating member of the agitating device is arranged to prevent damage of the agitating device due to forces resisting agitation motion by the agitating member. The developer applicator has a sleeve member for holding a developer on its surface, and a developer regulating blade which regulates the developer layer thickness, on the surface of the sleeve member, to provide an uniform developer thickness in the width direction. The cleaning device includes a toner removing device for removing residual toner from the electrostatographic material, a toner collecting chamber and a toner conveying passage extending from the toner recovery housing to the toner collecting chamber. The toner removing device includes a cleaning blade which, when the process unit is mounted at a predetermined position in the image-forming machine, is moved from a non-operative position away from the electrostatographic material to an operative position wherein it is brought elastically into contact with the electrostatographic material. A toner conveying device having a coil is disposed in the toner conveying passage.

24 Claims, 11 Drawing Sheets

FIG. 7
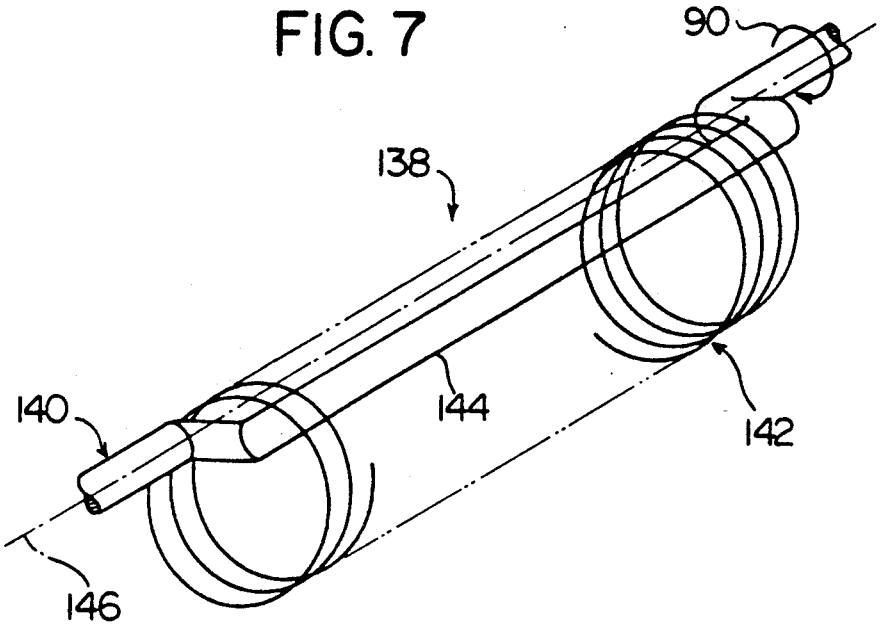
FIG. 8-A
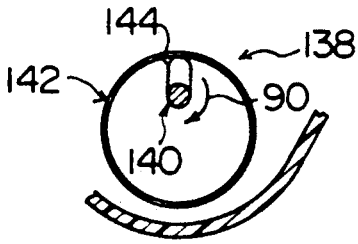
FIG. 8-B
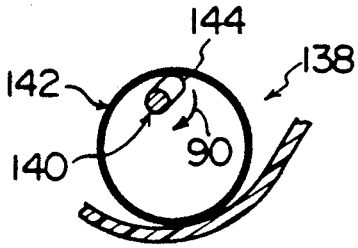
FIG. 8-C
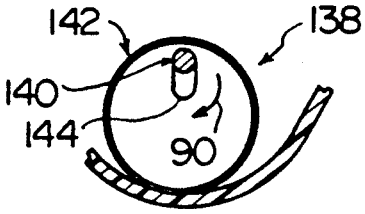
FIG. 8-D
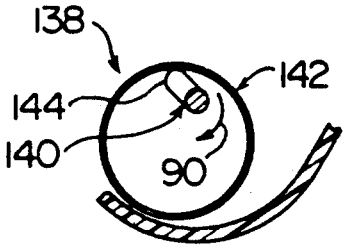

IMAGE-FORMING MACHINE WITH IMPROVED DEVELOPER AGITATING MEANS, DEVELOPER REGULATING BLADE MEANS, CLEANING DEVICE, AND TONER RECOVERY SYSTEM

FIELD OF THE INVENTION

This invention relates to an image-forming machine, such as a printer or a copying machine, of the electrostatic type which forms a latent electrostatic image on an electrostatographic material, developing it to a toner image, and thereafter, transferring the toner image to a receptor material.

DESCRIPTION OF THE PRIOR ART

Image-forming machines such as printers or copying machines of the above-described electrostatic type have been widely used. Such an image-forming machine usually comprises an electrostatographic material disposed on the surface of a rotating drum or an endless belt, a latent electrostatic image-forming means for forming a latent electrostatic image on the electrostatographic material, a developing device for developing the latent electrostatic image to a toner image, a transfer means for transferring the toner image on the electrostatographic material to a receptor material which may usually be a sheet of paper, and a cleaning device for removing the residual toner from the electrostatographic material after the toner image is transferred therefrom. The latent electrostatic image-forming means includes a charging corona discharger for uniformly charging the electrostatographic material and an optical system for selectively exposing the electrostatographic material corresponding to an image to be formed. A typical example of the developing device includes a development housing holding a developer, a developer applicator means for applying the developer in the development housing to the electrostatographic material, and an agitating means for agitating the developer within the development housing. The agitating means includes a rotating shaft to be rotated in a predetermined direction and an agitating member fixed to the rotating shaft. The developer applicator means usually has a sleeve member which holds the developer on its surface and conveys it, and in this case, there is provided a developer restricting blade which restricts the thickness of the developer layer conveyed while being held on the surface of the sleeve member. The developer may be a one-component developer composed of toner particles only or a two-component developer composed of toner particles and carrier particles. A typical example of the cleaning device comprises a toner removing means for removing the residual toner from the electrostatographic material, and a toner recovery housing extending in the width direction along the electrostatographic material for receiving the toner removed from the electrostatographic material by the toner removing means. The toner removing means is conveniently comprised of a cleaning blade which is adapted to make contact with the electrostatographic material by being elastically biased. The cleaning means, in many cases, further includes a toner collecting chamber that can be formed within a rotating drum on the surface of which the electrostatographic material is disposed, or within the developing device. In this case, there are also disposed a toner conveying passage extending from one end of the toner recovery housing to the toner collecting chamber, a toner transferring means for transferring the toner received in the toner recovery housing to one end of the toner recovery housing and a toner conveying means for conveying the toner from one end of the toner recovery housing to the toner collecting chamber through the toner conveying passage.

In a relatively small-sized image forming machine, it is convenient to construct a replaceable process unit by combining the electrostatographic material with the developing device and/or the cleaning device, and mount it detachably on a desired site. In this case, a cover member adapted to be selectively held at a covering position at which it covers part of the electrostatographic material is also provided. The cover member may be detachably mounted on the process unit in a mode in which it is held at the covering position; or in a mode in which it is free to move between the covering position and a non-covering position at which it exposes part of the electrostatographic material to view. In some cases, the charging corona discharger in the latent electrostatic image-forming means is also included in the process unit.

The conventional image-forming machines described above, however, have the following problems to be solved.

Firstly, at the time of starting the operation of the image-forming machine, the rotation resisting force exerted on the agitating member by the developer becomes excessively large, and is likely to damage the agitating member itself or a drive linking mechanism for rotating the rotating shaft. This problem is especially pronounced when the developer is a one-component developer of a relatively high bulk density and a relatively large amount of the developer is present in the developer housing. This problem could be solved by sufficiently increasing the strength of the agitating member and the drive coupling mechanism. However, it would necessarily increase the cost of production and the size of the machine.

Secondly, it is important that the thickness of the developer layer conveyed while being held on the surface of the sleeve member should be restricted entirely in the width direction to a sufficiently uniform value of, for example, about 50 to 100 micrometers by the developer restricting blade. It is especially so when the developer is a one-component developer. However, in the prior art, the pressing force of the inside surface of the free end portion of the developer restricting blade against the surface of the sleeve member is difficult to make sufficiently uniform entirely in the width direction. It is difficult therefore to restrict the thickness of the developer layer held on the surface of the sleeve member to a required uniform value in the width direction.

Thirdly, when at least the cleaning device is combined with the electrostatographic material to constitute a detachable process unit, it is necessary to bias the cleaning blade in the cleaning device elastically and bring it into contact with the electrostatographic material when the process unit is mounted on a required site and actually used. When the process unit is not mounted on the required site, it is desired to separate the cleaning blade from the electrostatographic material and avoid deterioration or damage in the electrostatographic material and/or the cleaning blade. The prior art, however, has failed to satisfy the above requirement without giving rise to another problem such as a great increase in the cost of production.

Fourthly, when the toner conveying passage, the toner transferring means and the toner conveying means are provided together with the toner collecting chamber, the toner conveying passage is usually constructed of a tubular member having a circular cross-sectional shape, and the toner conveying means is formed of a coil extending within the tubular member. The coil is drivingly connected to the rotating shaft of the toner transferring means and must be rotated in a required direction according to the rotation of the rotating shaft. In the prior art, the coil is drivingly connected to the rotating shaft by forming a hole in the rotating shaft, and anchoring one end portion of the coil in the hole or by fixing one end portion of the coil to the rotating shaft by a suitable set screw or the like. However, this method of driving connection is not entirely easy, and often requires a complex operation.

Fifthly, the corona discharger for applying a corona discharge to the electrostatographic material is conveniently of the scorotron-type comprising a grid electrode located between the electrostatographic material and a discharge wire. Because of the grid electrode itself and the manner of its electrical connection, the conventional scorotron-type corona discharger requires a much higher cost of production than a scorotron-type corona discharger which does not include a grid electrode.

SUMMARY OF THE INVENTION

It is a first object of this invention to prevent the agitating member and its related drive connecting mechanism exactly from undergoing damage even when the developer exerts an excessively large rotation resisting force on the agitating member of the developer agitating means in the latent electrostatic image developing device without giving rise to other problems such as an increase in the cost of production and size.

A second object of this invention is to easily make the pressing force of the inside surface of the free end portion of the developer restricting blade against the surface of the sleeve member sufficiently uniform and restrict the thickness of the developer layer held on the surface of the sleeve member to a required uniform value all the way in the width direction in the latent electrostatic image-developing device without involving a great increase in the cost of production.

A third object of this invention is to separate the cleaning blade in the cleaning device from the electrostatographic material when the process unit is not mounted on a required position but keep it in contact with the electrostatographic material when the process unit is mounted on the required site and actually used, without giving rise to another problem such as a great increase in the cost of production.

A fourth object of this invention is to make it possible to drivingly connect the upstream end portion of a coil constituting the toner conveying means in the cleaning device very easily and rapidly to the rotating shaft of the toner transferring means.

A fifth object of this invention is to improve the form of the grid electrode in the scorotron-type corona discharger and the manner of its electrical connection in order to greatly decrease the cost of production.

A novel feature of this invention which achieves the first object is that in a latent electrostatic image developing device, an agitating member is mounted on the rotating shaft of developer agitating means so that when a rotation resisting force of a magnitude above a predetermined value is exerted on the agitating member, the agitating member can slip with respect to the rotating shaft.

Another novel feature of the invention which achieves the first object is that in a latent electrostatic image developing device, an agitating member having an inside diameter larger than the outside diameter of the rotating shaft of the developer agitating means is formed, and idly fitted over the rotating shaft.

A novel feature of the invention which achieves the second object is that in a latent electrostatic developing device, the developer restricting blade in which the inside surface of its free end portion is to be pressed against the surface of the sleeve member is formed from a thin plate, a pressing member extending in the width direction is disposed on the outside surface of the free end portion of the developer restricting blade through a flexible member extending in the width direction, and the inside surface of the free end portion of the developer restricting blade is pressed against the surface of the sleeve member by the force acting on the pressing member.

A novel feature of the invention which achieves the third object is that in a process unit comprising the electrostatographic material and at least the cleaning device, the cleaning blade of the cleaning device is mounted so as to be free to move between an operating position at which it makes contact with the electrostatographic material and a non-operating position at which it departs from the electrostatographic material and the cleaning blade is elastically biased to the operating position by spring means, and moreover, a forcing means is disposed which forces the cleaning blade into the non-operating position against the elastic biasing action of the spring means when the cover member of the process unit is brought to the covering position at which it covers part of the electrostatographic material.

A novel feature of the invention which achieves the fourth object is that in the cleaning device, a coil-receiving flange is formed at one end portion of the rotating shaft of the toner transferring means, and the upstream end portion of the coil constituting the toner conveying means is fitted over a coil-receiving portion located on the rotating shaft at a site nearer to the end of the rotating shaft than the flange, and the winding direction of the coil is made such that the coil is tensioned when incident to the rotation of the rotating shaft in a predetermined direction, the coil is rotated in the predetermined direction.

A novel feature of the invention which achieves the fifth object is that the grid electrode in the corona discharger is formed of a thin conductive metal plate in such a form that it has a grid portion having many openings and a strip-like input terminal portion projecting from one end of the grid portion.

BRIEF DESCRIPTION OF THE DRAWINGS

FIG. 7 is a perspective view showing another embodiment of the developer agitating means;

FIGS. 8-A, 8-B, 8-C and 8-D are partial sectional views for illustrating the action of the developer agitating means of FIG. 7;

DETAILED DESCRIPTION OF PREFERRED EMBODIMENTS

With reference to the accompanying drawings, preferred embodiments of the image-forming machines of this invention improved in various respects will be described below in detail.

Figure 1:
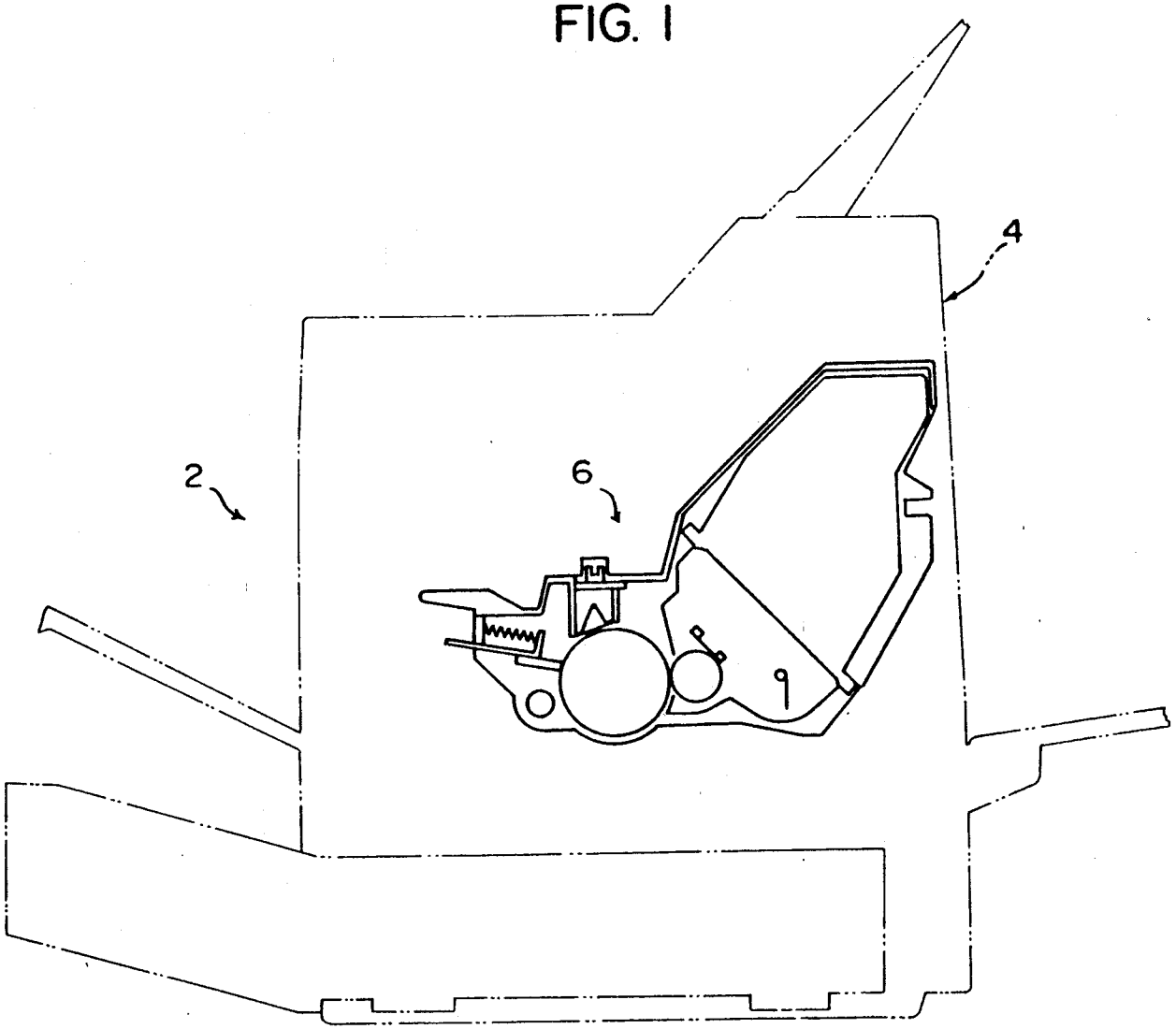
FIG. 1 is a simplified view showing a laser beam printer as one specific embodiment of the image-forming machine constructed in accordance with this invention.

FIG. 1 shows a laser beam printer shown generally at 2. The printer is comprised of a printer body 4 shown by a two-dot chain line in a simplified manner and a process unit 6 to be mounted detachably on the printer body 4. The structure of the printer 2 excepting the structure of the process unit 6 and the method of mounting and detaching the process unit 6 on and from the printer body 4 may be substantially the same as in the laser beam printer described and shown in detail in the specifications and drawings of Japanese Patent Applications Nos. 290740/1987 (filed on Nov. 19, 1987 and entitled "Image-Forming Machine") and 301775/1987 (filed on Nov. 30 and entitled "Image-Forming Machine"). Accordingly, these applications are cited herein by way of reference, and a detailed description of the structure of the printer 2 and the method of mounting and detaching the process unit 6 is omitted herein.

Figure 2:
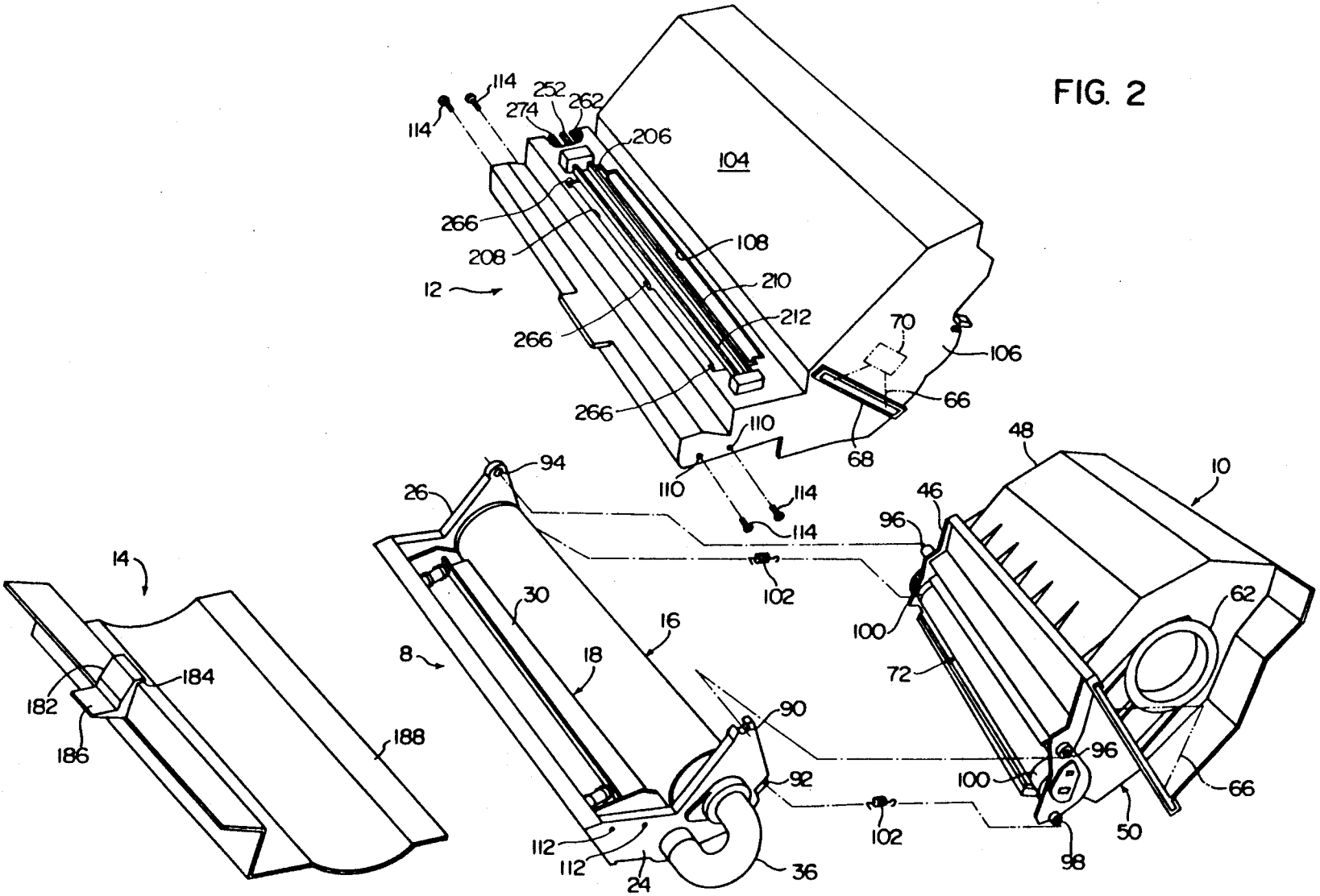
FIG. 2 is an exploded view showing a process unit for use in the laser beam printer of FIG. 1.
Figure 3:
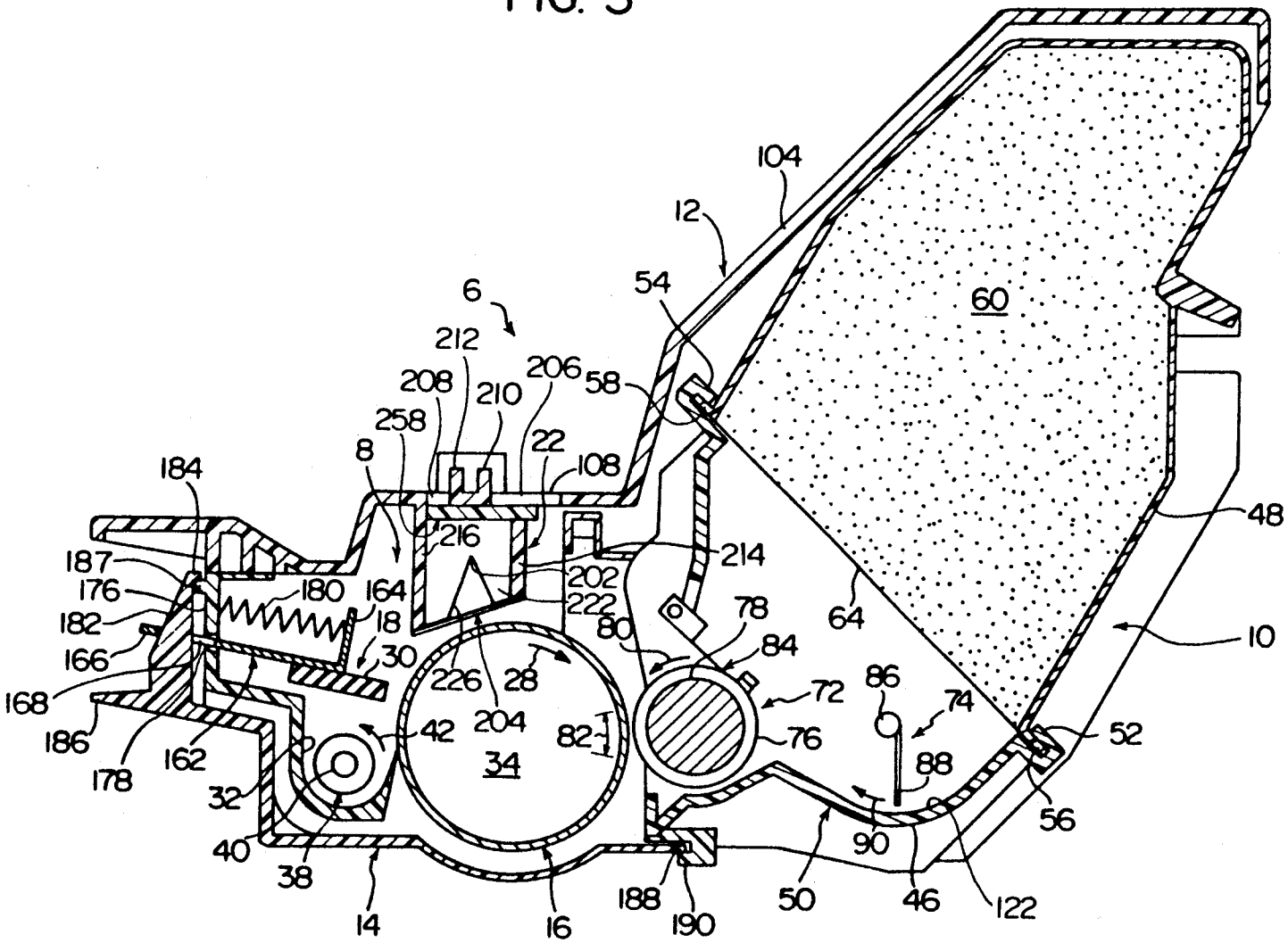
FIG. 3 is a sectional view showing a process unit for use in the laser beam printer of FIG. 1.

With reference to FIG. 2, the process unit in the illustrated embodiment is constructed by assembling four components each formed and assembled independently, namely a first component 8, a second component 10, a third component 12 and a fourth component 14. With reference to FIGS. 2 and 3, the first component 8 has a rotating drum 16 and a cleaning device 18. The second component 10 is a developing device. The third component constitutes an upper fixed cover member covering a greater portion of the upper surfaces and both side surfaces of the first and second components 8 and 10 and at the same time, includes a charging corona discharger 22. The fourth component 14 is a cover member for covering the lower portion of the rotating drum 16 and detachably mounted on the covering position shown in FIG. 3.

Further, with reference to FIGS. 2 and 3, the first component 8 has a pair of supporting side walls 24 and 26 dispersed with a predetermined distance therebetween, and the rotating drum 16 is rotatably mounted between these supporting walls 24 and 26. An electrostatographic material which may be formed of a suitable material such as an organic photosemiconductor is disposed on the peripheral surface of the rotating drum 16. The rotating drum 16 has an input shaft (not shown) projecting through the supporting side wall 26. When the process unit 6 is mounted in position on the printer body 4 (FIG. 1), the input shaft is drivingly coupled to a driving source (not shown) which may be an electric motor via a suitable drive coupling means (not shown), and at the time of performing the image-forming process, the rotating drum 16 is rotated in the direction shown by an arrow 28. The cleaning device 18 includes a cleaning blade 30 adapted to make contact with the peripheral surface of the rotating drum 16 by being biased elastically. The cleaning blade 30 constitutes a toner removing means for removing the residual toner from the peripheral surface of the rotating drum 16 after a toner image formed on the peripheral surface is transferred to a receptor material. The method of mounting the cleaning blade 30 and its related structure will be described in detail later on. The cleaning device 18 includes a toner recovery housing 32 disposed below the cleaning blade 30. The toner recovery housing 32 extends between the supporting side walls 24 and 26 alongside the rotating drum 16, and receives the toner which is scraped off downwardly from the rotating drum 16 by the cleaning blade 30. In the illustrated embodiment, a toner collecting chamber 34 is formed within the rotating drum 16, and a toner conveying passage 36 permitting communication of the toner recovery housing 32 with the toner collecting chamber 34 is provided. The toner conveying passage 36 formed of a tubular member having a circular cross-sectional shape extends in a nearly U-shaped configuration from one end of the toner recovery housing 32 through the supporting side wall 24, again passed through the supporting side wall 24 and advances into the toner collecting chamber 34 (see FIG. 16 also). A toner transferring means 38 is disposed in the toner recovery housing 32 for transferring the toner received in the toner recovery housing 32 to that end of the housing 32 at which the upstream end of the toner conveying passage 36 exists. The toner transferring means 38 may be comprised of a helical blade mechanism having a rotating shaft 40. The rotating shaft 40 of the toner transferring means 38 is drivingly coupled to the rotating drum 16 by a suitable drive coupling means (not shown) such as a gear train, and is rotated in the direction of an arrow 42 when the rotating drum 16 is rotated in the direction of arrow 28. A toner conveying means 44 (FIG. 16) is disposed within the toner conveying passage 36 for conveying the toner from one end of the toner recovery housing 32 to the toner collecting chamber 34 through the toner conveying passage 36. The toner conveying means 44 may be comprised of a coil (FIG. 16) extending within the toner conveying passage 36. The upstream end portion of the coil is drivingly coupled to the rotating shaft 40 of the toner transferring means 38, and incident to the rotation of the rotating shaft 40, the coil is rotated. The driving coupling between the coil constituting the toner conveying means 44 and the rotating shaft 40 of the toner transferring means 38 will be described below in detail.

Again with reference to FIGS. 2 and 3, the second component or developing device 10 includes a development housing 50 comprised of a main development housing member 46 and a developer cartridge member 48. An opening is formed in the left side surface of the main development housing member 46 in FIG. 3, and an opening is also formed in its inclined upper surface located at the right top in FIG. 3. Guiding channels 52 and 54 extending in the width direction (the direction perpendicular to the sheet surface in FIG. 3) are formed in both end edge portions of the inclined upper surface of the main development housing member 46. The developer cartridge member 48 has an inclined lower surface located at the left bottom in FIG. 3, and guide protrusions 56 and 58 extending in the width direction are formed in both end edge portions of the inclined lower surface. The developer cartridge member 48 is combined with the main development housing member 46 by sliding it and insert its guide protrusions 56 and 58 into the guiding channels 52 and 54 of the main development housing 46. A developer 60 which may be a one-component developer composed only of a magnetic toner is filled in the developer cartridge member 48 through a filling port (not shown) formed at its one side wall. The filling port is closed by bonding a closing member 62 (FIG. 2) to it after the developer 60 is filled. The inclined lower surface of the developer cartridge member 48 is sealed up by an openable sealing member 64 which may be of any known form. When the components 8, 10, 12 and 14 constituting the process unit 6 are combined properly, an opening protruding end portion 66 of the sealing member 64 is projected outwardly through a slit 68 formed in the front side wall 106 of the third component 12, and bonded to the surface of the front side wall 106 by means of a bonding piece 70, as indicated by a two-dot chain line in FIG. 2. Until the process unit 6 is actually put to use, the sealing member 64 is kept unopened, and therefore the developer 60 is held only in the developer cartridge member 48 and therefore no developer 60 exists in the developer housing member 46. When the process unit is to be mounted in position on the printer body 4 (FIG. 1), the sealing member 64 is removed from the inclined lower surface of the developer cartridge member 48 by pulling the protruding end portion 66 (FIG. 2), and the inclined lower surface is opened. As a result, the developer 60 is permitted to flow from the cartridge member 48 into the main development housing member 46.

A developer applicator means 72 and a developer agitating means 74 are disposed in the main development housing member 46. The developer applicator means 72 has a rotatably mounted sleeve member 76 and a stationary permanent magnet 78 disposed in the sleeve member 76. When the developing device 10 is combined with the first component 8 in the manner to be described hereinafter, the sleeve member 76 is drivingly coupled to the rotating drum 16 via a suitable drive coupling means such as a gear train, and when the drum 16 is rotated in the direction shown by arrow 28, the sleeve member 76 is rotated in the direction shown by an arrow 80. The sleeve member 76 conveys the developer 60 in the main development housing member 46 to a developing zone 82 while holding it to its surface by the magnetic attracting force of the permanent magnet 78, and consequently, the developer 60 is applied to a latent electrostatic image formed on the peripheral surface of the rotating drum 16 in the developing zone 82. The developer applicator 72 further has a developer restricting blade 84 for restricting the thickness of the layer of the developer 60 held on the surface of the sleeve member 76 and conveyed to the developing zone 82 to a required value which may be about 50 to 100 micrometers. The inside surface of the free end of the developer restricting blade 84 is pressed against the surface of the sleeve member 76 and restrict the thickness of the layer of the developer 60 held the surface of the sleeve member 76 to the required value. The developer restricting blade 84 in the developer application 72 will be described in more detail hereinafter.

The developer agitating means 74 has a rotating shaft 86 extending in the width direction (the direction perpendicular to the sheet surface in FIG. 3) and an agitating member 88 mounted on the rotating shaft 86. The rotating shaft 86 is drivingly coupled to the sleeve member 76 via a suitable drive coupling means (not shown) such as a gear train, and is rotated in the direction shown by an arrow 90 when the rotating drum 16 is rotated in the direction of arrow 28 and the sleeve member 76, in the direction of arrow 80. Thus, the developer agitating means 74 agitates the developer 60 in the main development housing member 46, and permits it to flow toward the sleeve member 76 of the developer applicator means 72. The developer agitating means 74 will be described in more detail hereinafter.

With reference to FIG. 2, the method of combining the first component 8 and the second component or developing device 10 will be described.

An anchoring groove 90 opened upwardly is formed in the right upper end portion of the supporting side wall 24 in the first component 8, and at its right lower end portion, a coil spring anchoring hole 92 is formed. An anchoring hole 94 is formed in the right upper end portion of the supporting side wall 26, and a coil spring anchoring hole (not shown) is formed in the right lower end portion of the supporting side wall 26. In the developing device 10, an engaging protrusion 96 located at an upper site and a coil spring anchoring protrusion 98 located at a lower site are formed in the outside surface of each of the side walls of the development housing 46. Spacer rings 100 are rotatably mounted on opposite sides of the sleeve member 76 of the developer applicator means 72 and concentrically with the sleeve member 76. The outside diameter of each of the spacer rings 100 is prescribed at a value larger than the outside diameter of the sleeve member 76 by a fixed amount. In combining the developing device 10 with the first component 8, one engaging protrusion 96 in the developing device 10 is inserted into the anchoring hole 94 in the first component 8, and then the other anchoring protrusion 96 in the developing device 10 is put into the anchoring groove 90 in the first component 8. Then, a coil spring 102 is stretched across the coil spring anchoring protrusion 98 in the developing device 10 and the coil spring anchoring hole 92 of the first component 8. As a result, the developing device 10 is elastically biased relative to the first component 8 clockwise as viewed from ahead in FIG. 2 about the anchoring protrusion 96 as a center, and the pair of spacer rings 100 in the developing device 10 are caused to abut with the surfaces of both side portions of the rotating drum 16 in the first component 8. Thus, the first component 8 and the developing device 10 are combined by precisely setting the distance between the peripheral surface of the rotating drum 16 and the peripheral surface of the sleeve member 76 of the developer application means 72 at a required value.

Further with reference to FIGS. 2 and 3, the third component or the upper fixed cover member 12 has an upper surface wall 104 having a shape nearly corresponding to the upper surface shapes of the first component 8 and the developing device 10, and a front side wall 106 and rear side wall 107 (FIG. 20) extending downwardly from both side edges of the upper surface wall 104. An exposure slit 108 extending slenderly in the width direction is formed in the upper surface wall 104. As shown in FIG. 3, the charging corona discharger 22 extending in the width direction is disposed in the inside of the upper surface wall 104 adjacent to the exposure slit 108. The above upper fixed cover member 12 is held at a required site at which it covers the upper surfaces and both side surfaces of the first component 8 and the developing device 10, and fixed to the first component 8 by applying a set screw 114 to screw holes 112 formed in the supporting side walls 24 and 26 of the first component 8 through holes formed in the left side portions of the side walls 106 and 107.

The fourth component or detachable cover member 14 is detachably mounted on the covering position shown in FIG. 3, and covers the lower portion of the rotating drum 16. As will be described in detail hereinbelow, when the process unit 6 is to be mounted on the printer body 4 (FIG. 1), the cover member 14 is removed from the process unit 6. When after mounting the process unit 6 on the printer body 4, the imageforming process is to be performed, the rotating drum 16 is rotated in the direction of arrow 28. The charging corona discharger 22 uniformly charges the peripheral surface of the rotating drum 16, and then a laser beam from a laser beam projecting means (not shown) is selectively projected onto the rotating drum 16 through the exposure slit 108. Thus, a latent electrostatic image is formed on the surface of the rotating drum 16. The latent electrostatic image is developed to a toner image by the developing device 10. Then, a receptor material (not shown) which may be plain paper is brought into intimate contact with the lower exposed portion of the rotating drum 16, and by the action of a transferring means (not shown) such as a transfer corona discharger, the toner image is transferred from the rotating drum 16 to the receptor material. The receptor material is then peeled off from the rotating drum 16, and by a suitable fixing means (not shown) the toner image is fixed to the receptor material, and then the receptor material having the fixed toner image is discharged from the printer 2. In the meantime, the toner remaining on the peripheral surface of the rotating drum 16 is removed from the rotating drum 16 by the cleaning device.

The following improvements have been made in the process unit 6 described hereinabove.

Developer agitating means

As already described with reference to FIG. 3, the developer agitating means 74 is disposed in the main development housing member 46 of the developing device 10. The developer agitating means 74 is comprised of a rotating shaft 86 extending in the width direction (the direction perpendicular to the sheet surface in FIG. 3) within the main development housing member 46 and a agitating member 88 mounted on the rotating shaft 86. In this invention, it is important that the agitating member 88 should be mounted on the rotating shaft 86 in such a manner that when a rotation resisting force of a magnitude above a certain limit is exerted on the agitating member 88 while the rotation shaft is in rotation in the direction of arrow 90, the agitating member 88 can slip with respect to the rotating shaft 86.

Figure 4:
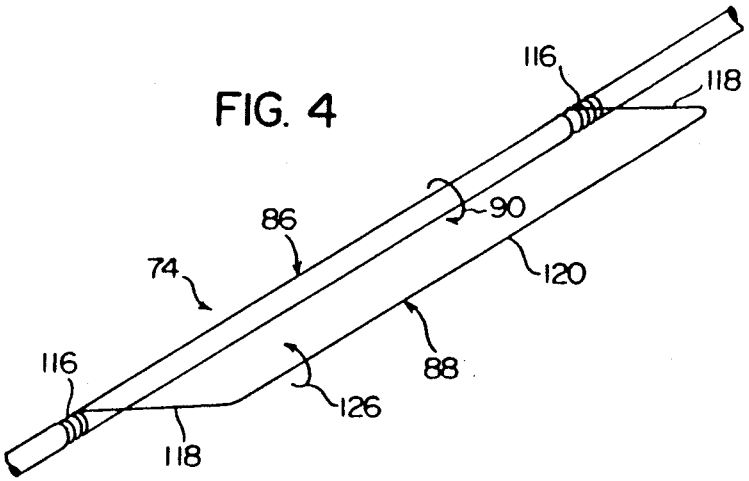
FIG. 4 is a perspective view showing a developer agitating means used in a developing device in the process units of FIGS. 2 and 3.
Figure 5:
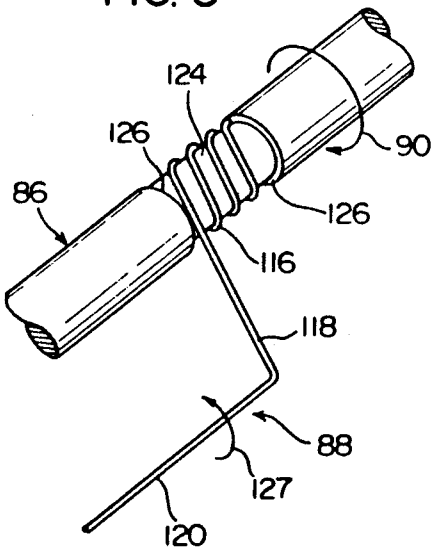
FIG. 5 is a partial perspective view showing a portion of the developer agitating means of FIG. 4.

With reference to FIG. 4 in conjunction with FIG. 3, the agitating member 88 in the illustrated embodiment is formed by properly deforming a single continuous metal wire which may be a stainless steel wire for a coil spring having a diameter of, for example, about 1.2 mm. The agitating member 88 has mounting portions 116 at both ends spaced from each other in the axial direction of the rotating shaft 86, an arm portion 118 extending substantially perpendicularly to the rotating shaft 86 and radially outwardly from the mounting portions 116 respectively, and a main agitating portion 120 extending between the arm portions 118 substantially in parallel to the rotating shaft 86. The mounting portion 116 at both ends are located at sites near both ends of the main development housing member 46 in the width direction, and therefore, the main agitating portion 120 conveniently extends within the main development housing member 46 nearly over its entire length of the development housing member 46 in the width direction. The radial length of each of the arm portions 118 is conveniently set such that as shown in FIG. 3 while the agitating member 88 is rotated in the direction of arrow 90 incident to the rotation of the rotating shaft 86, the main agitating portion 120 moves in proximity to the inside surface 122 of the arcuate bottom wall of the main development housing member 46. With reference to FIGS. 4 and 5, the mounting portion 116 at both ends of the agitating member 98 is formed in a coil spring shape, and fitted over a receiving portion 124 (FIG. 5). The inside diameter of the mounting portion 116 in a free condition is set slightly smaller than the outside diameter of the receiving portion 124 of the rotating shaft 86. The mounting portion 116 is elastically put over the receiving portion 124 of the rotating shaft 86 by elastically increasing its inside diameter. As clearly shown in FIG. 5, the receiving portion 124 of the rotating shaft 86 is preferably made slightly smaller in diameter than the rest of the shaft 86, and annular shoulder surfaces 126 are formed on both sides of the receiving portion 124. The annular shoulder surfaces 126 prevent the mounting portion 116 of the agitating member 88 from moving axially with respect to the rotating shaft 86. Preferably, the winding direction of the agitating member 88 at the mounting portion 116 is such that it is loosened when the agitating member 88 is relatively revolved in a direction shown by an arrow 127 (the direction opposite to the rotating direction 90 of the rotating shaft 86).

As stated hereinabove with regard to the prior art, when the developer 60 is a one-component developer having a relatively high density and a relatively large amount of the developer 60 exists in the developer housing 50, it is not rare that at the time of starting the initial operation of the process unit 6 or at the time of starting the operation after stoppage for a relatively long period of time (for example, at the time of starting the operation every morning), an excessively large rotation resisting force acts on the agitating member 88 of the agitating means 74 owing to the pressing and aggregation of the developer 60 around the developer agitating means 74. In contrast, in the developer agitating means 74 improved in accordance with this invention, the mounting portion 116 of the agitating member 88 is elastically fitted over the rotating shaft 86, and when an excessive rotation resisting force acts on the agitating member 88, the agitating member 88 can slip with respect to the rotating shaft 86. Accordingly, when the rotating shaft 86 of the developer agitating means 74 begins rotation in the direction of arrow 90 incident to the starting the use of the process unit 6 and the rotation resisting force on the agitating member 88 is excessively large, the agitating member 88 slips with respect to the rotating shaft 86 and an excessively large rotation resisting force is cushioned. As a result, the damage of the agitating member 88 or a drive coupling mechanism (not shown) relating to the rotating shaft 86 is accurately prevented. The degree of drive coupling of the rotating shaft 86 and the agitating member 88, or in other words, the rotation resisting force which causes the agitating member 88 to slip with respect to the rotating shaft 86, can be properly set based on experiment, etc. When the developer applicator means 72 of the developing device 10 applies the developer 60 to the latent electrostatic image, the developer 60 is consumed and some space is created near the developer applicator means 72. Consequently, the developer 60 flows and the rotation resisting force on the agitating member 88 abrubtly decreases. Then, the agitating member 88 is rotated in the direction of arrow 90 incident to the rotation of the rotating shaft 86.

Figure 6:
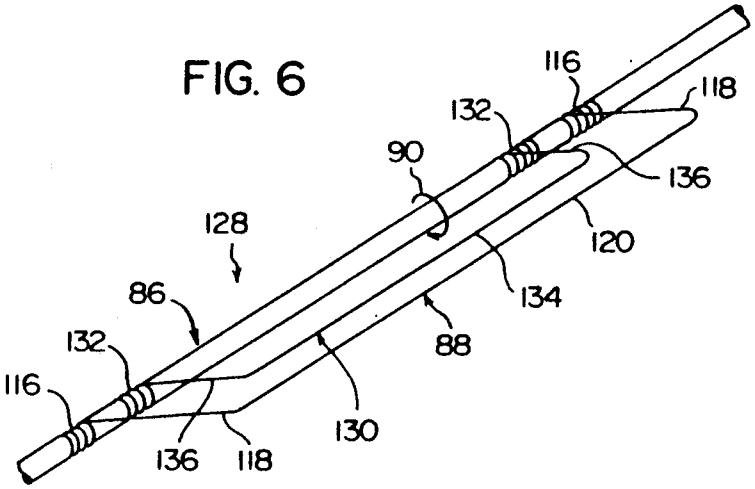
FIG. 6 is a perspective view showing a modified example of the developer agitating means of FIGS. 4 and 5.

FIG. 6 shows a modified example of the developer agitating means. In this developer agitating means 128, an agitating member 88 substantially the same as the agitating member 88 shown in FIG. 5 and an additional agitating member 130 are secured to the rotating shaft 86 to be rotated in the direction of arrow 90. The additional agitating member 130 differs from the agitating member 88 in that both end mounting portions 132 are arranged inwardly of the two end mounting portion 116 of the agitating member 88 and therefore the axial length of a main agitation operative portion 134 is relatively short, and that the radial length of an arm portion 136 is shorter than the arm portion 118 of the agitating member 88 and therefore the distance between the rotating shaft 86 and the main agitation operative portion 134 is relatively small. The method of mounting on the rotating shaft 86 is substantially the same as the agitating member 88. Since in the developer agitating means 128 depicted in FIG. 6, the main agitation operative portion 134 of the agitating member 130 is smaller than the main agitation operative portion 120 of the agitating member 88, the rotation resisting force acting on the agitating member 130 is usually smaller than that acting on the agitating member 88. Accordingly, when the degree of drive coupling of the agitating member 88 with respect to the rotating shaft 86 is substantially the same as that of the agitating member 130 with respect to the rotating shaft 86, and the rotation resisting force acting on the agitating members 88 and 130 is excessively large, the agitating member 130 begins rotation incident to the rotating shaft 86 after the lapse of some time from the starting the operation of the developing device 10, and then with some delay in time, the agitating member 88 begins rotation incident to the rotating shaft 86. If desired, it is possible to mount a plurality of agitating members having a relatively short axial length on the rotating shaft 86 at suitable axial intervals.

FIG. 7 shows another embodiment of the developer agitating means improved in accordance with this invention. The developer agitating means shown generally at 138 is comprised of a rotating shaft 140 to be rotated in the direction of arrow 90 and an agitating member 142 mounted on the rotating shaft 140. The rotating shaft 140 has formed therein a so-called crank-like deformed portion 144 which constitutes an eccentric portion made eccentric by a predetermined amount with respect to the central axis 146 of the rotating shaft 140. Rotation of the shaft 140 and the eccentric portion 144 defines a cylinder having an outside diameter. The agitating member 142 is formed of a coil having a relatively large inside diameter, larger than the outside diameter of the cylinder defined by the rotating shaft and eccentric portion and is simply fitted idly over the rotating shaft 140 and eccentric portion 144. It will be understood by reference to FIGS. 8-A, 8-B, 8-C and 8-D that when the rotating shaft 140 is rotated in the direction of arrow 90, the agitating member 142 is properly vibrated in the radial direction by the action of the crank-like deformed portion 144. Furthermore, owing to the friction between the agitating member 142 and the crank-like deformed portion 144 of the rotating shaft 140, the agitating member 142 is rotated in the direction of arrow 90 to some extent incident to the rotation of the rotating shaft 140. If desired, it is possible to provide at the inside surface of the agitating member 142 a protrusion with which the crank-like deformed portion 144 can engage intermittently, and accurately rotate the agitating member 142 intermittently by a predetermined angle according to the rotation of the rotating shaft 140. As stated above, the agitating member 142 is simply fitted idly over the rotating shaft 140. Thus, when the excessively large rotation resisting force acts on the agitating member 142, the agitating member 142 slips with respect to the rotating shaft 140 and the excessively large rotation resisting force is cushioned.

Figure 9:
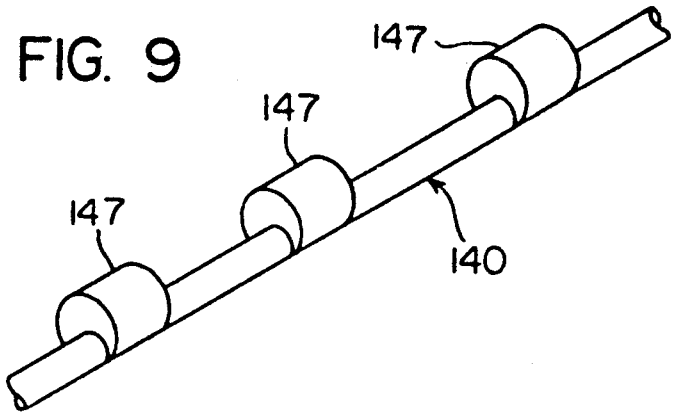
FIGS. 9, 10 and 11 are perspective views showing modified examples of the developer agitating means of FIG. 7.
Figure 10:
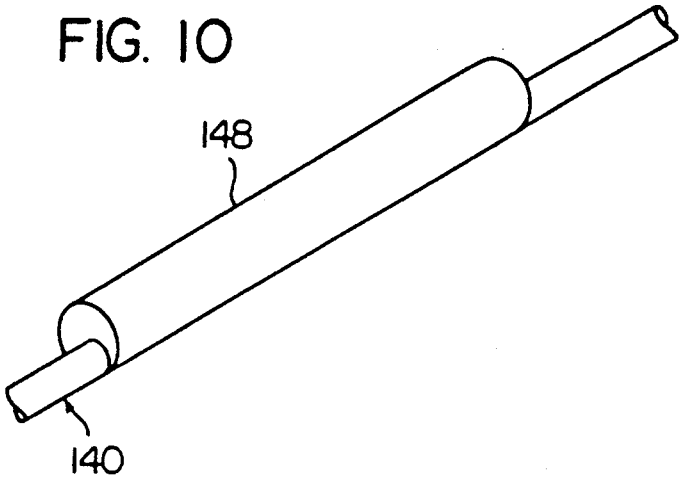
Figure 11:
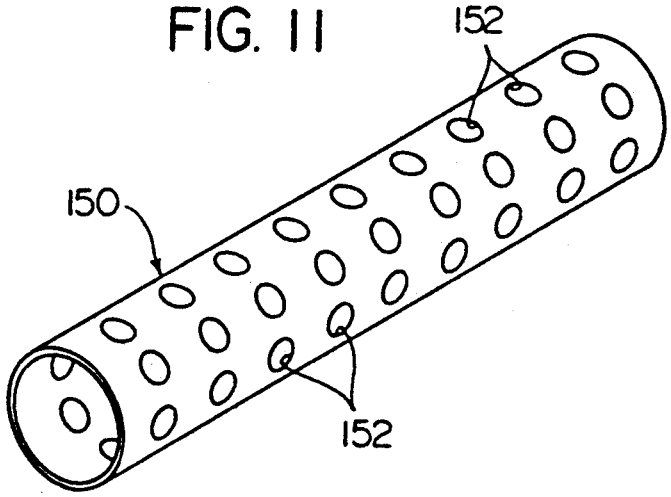

If desired, instead of forming the crank-like deformed portion 144 in the rotating shaft 140, it is possible to form a plurality of axially spaced eccentric cylindrical portions 147 in the rotating shaft 140 as shown in FIG. 9, or one relatively long eccentric cylindrical portion 148 extending continuously in the axial direction in the rotating shaft 140 as shown in FIG. 10. It is also possible if desired to use an agitating member 150 shown in FIG. 11 instead of the coil-like agitating member 142. The agitating member 150 is of a hollow cylindrical shape, and a plurality of pores 152 are formed in its cylindrical wall. This agitating member 150, too, is mounted on the rotating shaft 140 by merely fitting it idly over the shaft 140. Instead of providing one axially extending relatively long agitating member 150, a plurality of relatively short axially extending agitating members may be mounted on the rotating shaft 140.

Developer restricting blade

Figure 12:
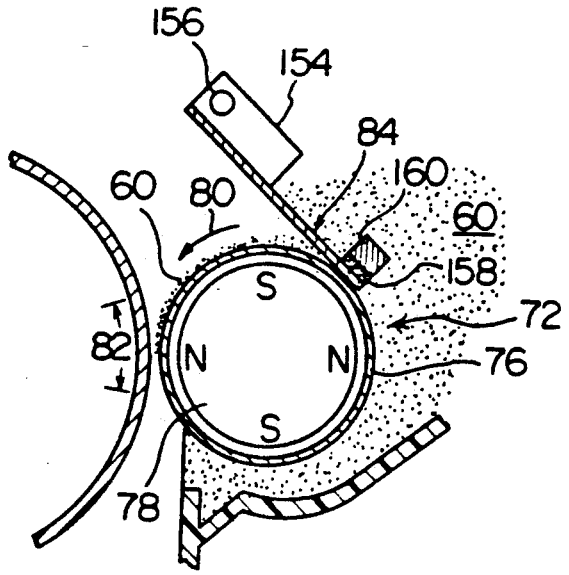
FIG. 12 is a partial sectional view showing a developer restricting blade used in the developing devices in the process units depicted in FIGS. 2 and 3.
Figure 13:
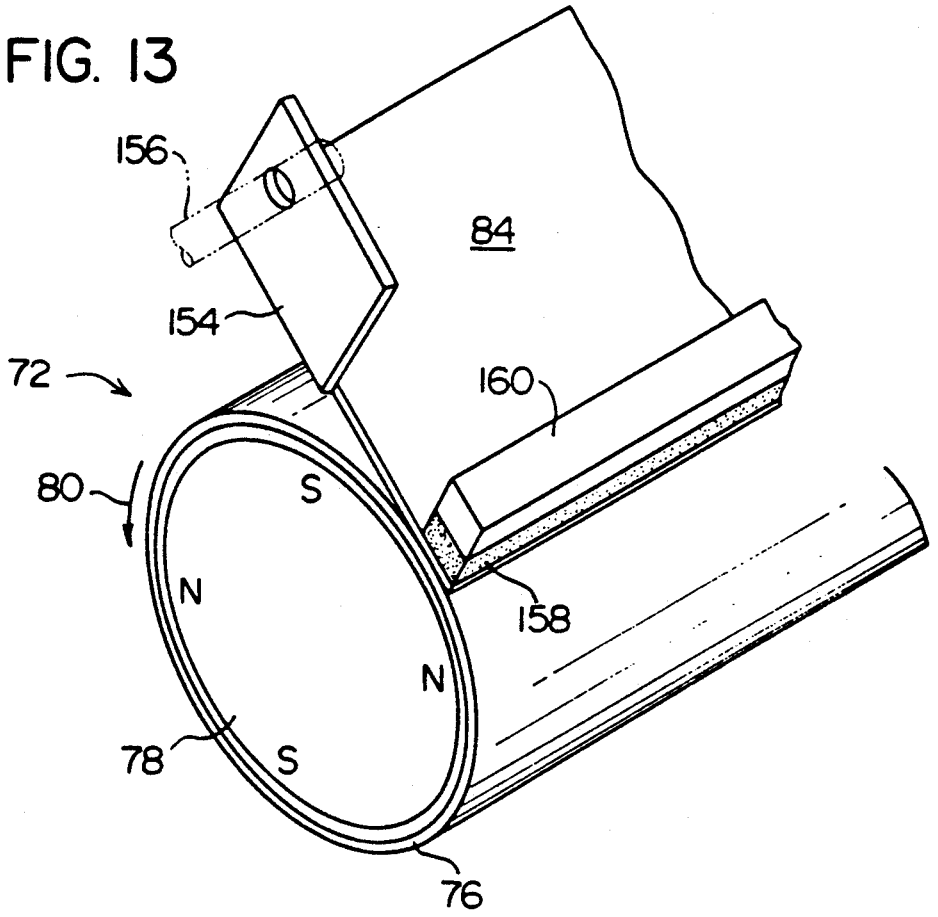
FIG. 13 is a partial perspective view showing the developer restricting blade of FIG. 12.

As already stated with reference to FIG. 3, the developer applicator means 72 in the development device 10 includes the sleeve member 76 to be rotated in the direction of arrow 80, the stationary permanent magnet 78 disposed within the sleeve member 76, and the developer regulating blade 84 for adjusting the thickness of the layer of the developer 60 held onto the surface of the sleeve member 76 and conveyed to the developing zone 82 to a predetermined value which may be 50 to 100 μm. With reference to FIGS. 12 and 13, the developer regulating blade 84 improved in accordance with this invention is constructed of a thin plate extending in the width direction along the sleeve member 76. It is important that this thin plate bends elastically relatively easily. Preferably, it is a thin metallic plate such as a thin phosphor bronze plate having a thickness of about 0.1 mm. Upstanding securing pieces 154 are formed at both side end base portions of the blade 84. A short rod 156 extending substantially parallel to the sleeve member 76 is provided in the inside surface of each of the side walls of the main development housing member 46. The upstanding securing pieces 154 are pivotally mounted on the short rods 156. As a result, the blade 84 is mounted so that it is free to pivot about the central axis of the short rods 156 extending substantially parallel with the central axes of the sleeve member 76. An elongated flexible member 158 extending along all the width of the blade 84 is fixedly secured to the outside surface (or the upper surface) of the free end portion of the blade 84 by bonding or otherwise. An elongated pressing member 160 extending along all the width of the blade is fixedly secured to the outside surface of the flexible member 158 by bonding or otherwise. The flexible member 158 which should be more pliable than the blade 84 and the pressing member 160 is preferably formed of, for example, a foamed plastic material such as formed polyurethane having a thickness of about 1 mm. On the other hand, the pressing member 160 is desirably formed of a magnetic material of a large weight, for example a thick metal plate such as an iron plate having a thickness of about 3 mm.

In the developer restricting blade 84 described above, the weight of the pressing member 160 itself, namely the relatively high gravity acting on the pressing member 160, acts on the free end portion of the blade 84 via the flexible member 158 whereby the inside surface of the free end portion of the blade 84 is pressed against the surface of the sleeve member 76. When the pressing member 160 is formed of a magnetic material, the stationary permanent magnet 78 disposed in the sleeve member 76 creates a magnetic attracting force to attract the pressing member 160 to the surface of the sleeve member 76. This magnetic attracting force acts on the free end portion of the blade 84 via the flexible member 158 and presses the inner surface of the free end portion of the blade 84 against the surface of the sleeve member 76.

Experiments conducted by the present inventors have shown that when the pressing member 160 is directly fixed to the outside surface of the free end portion of the blade 84 without providing the flexible member 158 therebetween, the pressing force of the inside surface of the free end portion of the blade 84 against the surface of the sleeve member 76 does not necessarily become uniform all the way in the width direction, it is extremely difficult, if not impossible, to adjust the thickness of the developer 60 conveyed to the developing zone 82 to a predetermined value uniformly all the way in the width direction. In contrast, when the pressing member 160 is fixedly secured to the outside surface of the free end portion of the blade 84 via the flexible member 158, the pressing force of the inside surface of the free end portion of the blade 84 against the surface of the sleeve member 76 can be rendered uniform all the way in the width direction, and therefore, the thickness of the layer of the developer conveyed to the developing zone 82 can be adjusted uniformly to a predetermined value all the way in the width direction.

The present inventors presume as follows with regard to this fact. If the flexible member 158 does not exist, the non-uniformity of the surface accuracy or the thickness accuracy of the pressing member 160 in the width direction directly affects the free end portion of the blade 84, and therefore, the pressing force of the inside surface of the free end portion of the blade 84 against the surface of the sleeve member 76 cannot be rendered uniform all the way in the width direction. When the flexible member 158 exists, however, the above non-uniformly of the surface accuracy or the thickness accuracy of the pressing member 160 in the width direction is cushioned or absorbed by the flexible member 158, and therefore, the pressing force of the inside surface of the free end portion of the blade 84 against the surface of the sleeve member 76 can be made uniform all the way in the width direction.

If desired, instead of fixing the flexible member 158 or the pressing member 160, or both to the outside surface of the free end portion of the blade 84, it is possible to mount the flexible member 158 or the pressing member 160 or both movably toward the outside surface of the free end portion of the blade 84 by using a suitable guiding member so that the pressing member 160 is pressed against the outside surface of the free end portion of the blade 84 via the flexible member 158 by the gravity and/or magnetic attracting force acting on the pressing member 160. Furthermore, instead of mounting the base portion of the blade 84 pivotally, it may, as required, be fixed at a suitable site.

Cleaning blade

Figure 14:
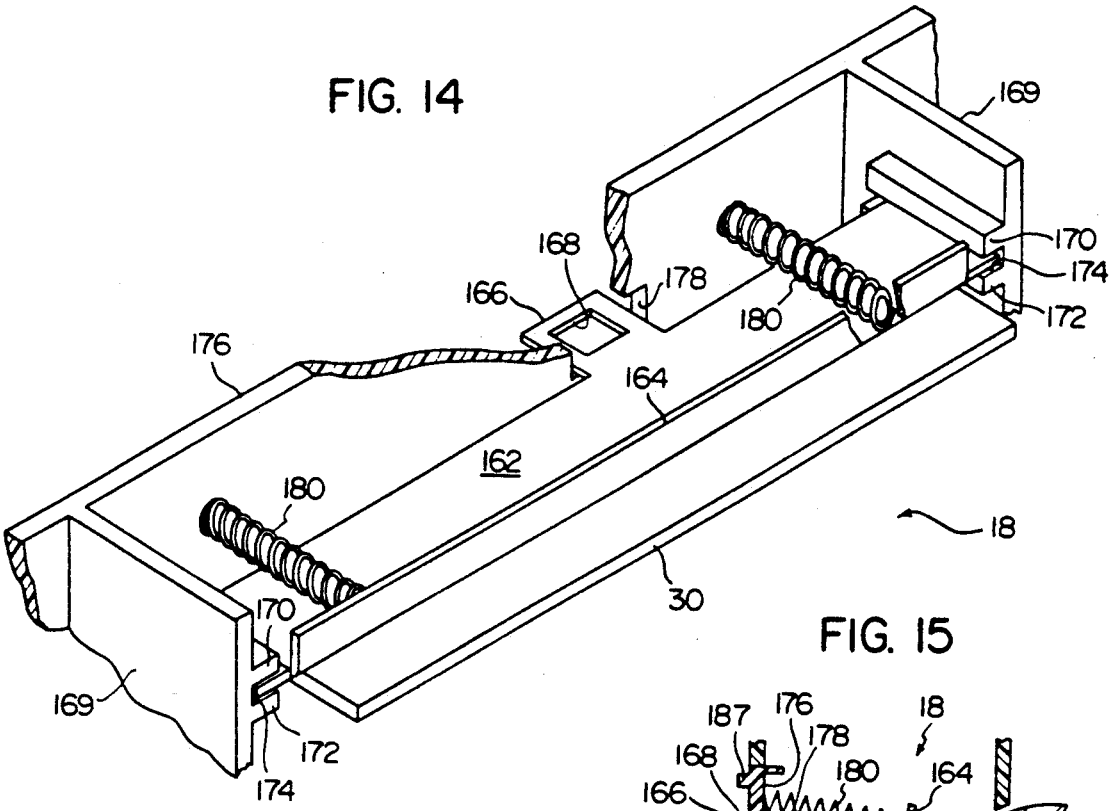
FIG. 14 is a partial perspective view showing the cleaning blade and its related parts used in the cleaning devices in the process units depicted in FIGS. 2 and 3.
Figure 15:
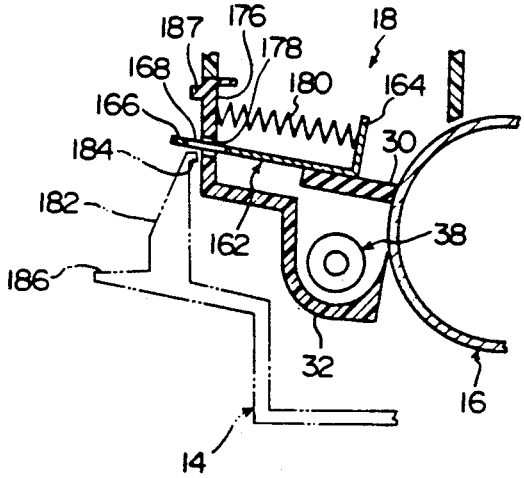
FIG. 15 is a partial sectional view showing the cleaning blade of FIG. 14 and its related parts.

With reference to FIGS. 14 and 15 as well as FIG. 3, in the process unit 6 improved in accordance with this invention, the cleaning blade 30 in the cleaning device 18 is mounted so as to be free to move between a non-operative position shown in FIG. 3 and an operative position shown in FIG. 15. Mainly with reference to FIG. 14, the cleaning blade 30, which may be an elongate plate-like member formed of a suitable elastomeric material such as synthetic rubber, is fixed at its base portion (i.e., the left end portion in FIGS. 3 and 15) to the under surface of a blade support 162 by bonding or otherwise. The blade support 162 which may be formed of a suitable metallic plate has a flat plate-like main portion extending slenderly in the width direction, and an upright wall 164 extending upwardly excepting it both side portions in the width direction is formed in the front edge (the right end edge in FIGS. 3 and 15) of the flat plate-like main portion. At the rear edge of the flat plate-like main portion is formed a rectangular projecting piece 166 projecting rearwardly from nearly the central part of the rear edge in its width direction. A rectangular opening 168 is formed in the projecting piece 166. As will be clear from the description hereinafter, the opening 168 constitutes an engaged means in a forcing means for forcing the cleaning blade 30 to the non-operative position. On the other hand, an upstanding subsidiary supporting side wall 169 is disposed inwardly of each of the supporting side walls 24 and 26 in the first component element 8. Guiding protrusions 170 and 172 extending parallel to each other with a predetermined distance therebetween in their inside surface of the subsidiary supporting side wall 169, and a guiding groove 174 is defined between the guiding protrusions 170 and 172. As can be seen from FIGS. 3 and 15, the guiding groove 174 extends roughly in the normal direction of the rotating drum. The blade support 162 can be mounted by inserting its both side portions in the width direction slidably in the guiding groove 174. Thus, the cleaning blade 30 is mounted so as to be free to move roughly in the normal direction of the rotating drum 16 between the operative position and the non-operative position. An opening 178 is formed in a nearly central part in the width direction in a rear wall 176 extending between the rear edges of the supporting inside walls 24 and 26, and the projecting piece 166 formed at the rear edge of the blade support 162 projects outwardly through the opening. Between the rear wall 176 and the upstanding wall 164 of the blade support 162 are disposed two compression coil blade support 162 are disposed two compression coil springs 180 spaced from each other in the width direction. The springs 180 elastically bias the blade 162 toward the rotating drum 16 and thus bias the cleaning blade elastically to an operative position at which the free end edge of the cleaning blade 30 makes contact with the surface of the rotating drum 16, namely to the operative position shown in FIG. 15. A short rod (not shown) for fitting over the end portion of the spring 180 may be provided in the inside surface of the rear wall 176 and the rear surface of the upright wall 164.

With reference to FIGS. 2 and 3, at the rear end edge (left end edge in FIG. 3) of the cover member 14 detachably mounted on the process unit 6 is formed a protrusion 182 extending upwardly from nearly the central part of the rear end edge in the width direction. This protrusion 182 constitutes an engaging means in the forcing means for forcing the cleaning blade 30 at the non-operative position. As is clearly shown in FIG. 3, the protrusion is preferably of a wedge shape whose thickness progressively decreases upwardly. A forwardly projecting lock protrusion 184 is attached to the upper end of the protrusion 182. A rearwardly extending press-down piece 186 is attached to the base end portion of the protrusion 182.

In mounting the cover member 14 on the process unit 6, a front end edge portion 188 of the cover member 14 is inserted into a receiving groove 190 (FIG. 3) formed in the lower end of the second component element which is the developing device 10. Then, the rear edge portion of the cover member 14 is elevated to the position shown in FIG. 3, and the lock protrusion 184 formed in the upper end of the protrusion 182 is elastically engaged with the engaging protrusion 187 (FIGS. 3 and 15) formed on the outside surface of the rear wall 176. As a result, the cover member 14 is detachably mounted at the covering position shown in FIG. 3. As can be seen by comparing FIG. 15 with FIG. 3, while the rear edge portion of the cover member 14 is elevated to the position shown in FIG. 3, the protrusion 182 formed in the cover member 14 gets into the opening 168 formed in the protruding piece 166 of the blade supporting member 162, and moves the blade support 162 and the cleaning blade 30 fixed thereto to the left in FIGS. 3 and 15 against the elastic biasing action of the springs 180. When the cover member 14 is mounted on the process unit 6, the cleaning blade 30 is forced and held at the non-operative position shown in FIG. 3. At the non-operative position, the cleaning blade 30 is moved away from the peripheral surface of the rotating drum 16. Accordingly, when the cover member 14 is mounted on the process unit 6 and the process unit 6 is not in use, the cleaning blade 30 is away from the peripheral surface of the rotating drum, and degradation and damage of the electrostatographic material and/or the cleaning blade are effectively prevented. In mounting the process unit 6 on the printer body 4 (FIG. 1), the cover member 14 is removed from the process unit 6 prior to the mounting of the process unit. At this time, the press-down piece 186 is pressed downwardly to displace the lock protrusion 184 elastically, and thus to remove it from the engaging protrusion 187 (FIGS. 3 and 15). Then, the rear edge portion of the cover member 14 is lowered and the protrusion 182 is detached from the opening 168 formed in the protruding piece 166 of the blade support 162. Thereafter, the front edge portion 188 of the cover member 14 is detached from the receiving groove 190 (FIG. 3) formed at the lower end of the developing device 10. When the protrusion 182 of the cover member 14 is detached from the opening 168 formed in the protruding piece 166 of the blade support 162, the cleaning blade 30 is moved to the operative position shown in FIG. 15 by the elastic biasing action of the springs 180, and the free end edge of the cleaning blade 30 is brought into contact with the peripheral surface of the rotating drum 16.

If desired, instead of detachably mounting the cover member 14 at the predetermined covering position of the process unit, it is possible to mount the cover member 14 so as to be free to move between the predetermined covering position and a non-covering position at which a predetermined portion of the peripheral surface of the rotating drum 16 is exposed to view, force the cleaning blade 30 to the non-operative position when the cover member 14 is held at the covering position, and elastically bias the cleaning blade 30 to the operative position when the cover member 14 is held at the non-covering position.

Toner transferring means and toner conveying means

As already stated with reference to FIG. 3, the cleaning device 18 in the illustrated embodiment includes the toner recovery housing 32 for receiving the toner removed from the peripheral surface of the rotating drum 16 by the action of the cleaning blade 30, the toner collecting chamber 34 formed within the rotating drum 16 and the toner conveying passage 36 extending from one end of the toner recovery housing 32 to the toner collecting chamber 34. Further disposed are the toner transferring means 38 for transferring the toner received in the toner recovery housing 32 to its one end and toner conveying means 44 for conveying the toner from one end of the toner recovery housing 32 to the toner collecting chamber 34 through the toner conveying passage 36. The toner transferring means 38 is constructed of a helical blade mechanism, and the toner conveying means 44, of a coil.

Figure 17:
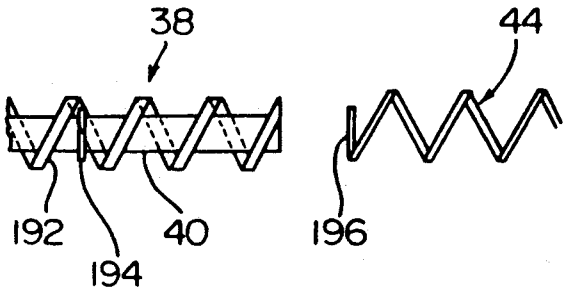
FIG. 17 is a partial exploded top plan view showing the toner transferring means and the toner conveying means of FIG. 16.
Figure 16:
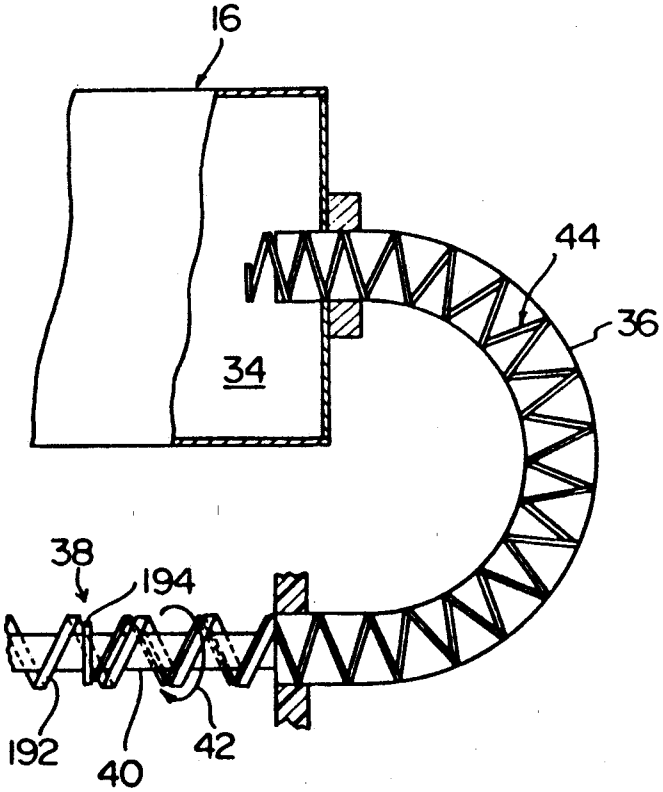
FIG. 16 is a partial sectional view showing a toner transferring means and a toner conveying means used in the cleaning devices in the process units depicted in FIGS. 2 and 3.

With reference to FIGS. 16 and 17 as well as FIG. 3, the toner transferring means 38 includes the rotating shaft 40 extending within the toner recovery housing 32 in the width direction (the direction perpendicular to the sheet surface in FIG. 3, and in the left-right direction in FIG. 16), and a helical blade 192 is formed on the peripheral surface of the rotating shaft 40. The helical blade is of a form which advances from left to right while revolving in the clockwise direction as viewed from left in FIG. 16. As clearly shown in FIG. 17, an annular, coil-receiving flange 194 is also formed in one end portion (the right end portion in FIGS. 16 and 17) of the rotating shaft 40. Conveniently, the outside diameter of the coil-receiving flange 194 is slightly smaller than the outside diameter of the helical blade 192. As will be described later on, that part of the rotating shaft 40 which is located right of the coil-receiving flange 194 constitutes a coil receiving portion over which the upstream end position of the coil constituting the toner conveying means 44 is fitted. In the illustrated embodiment, a portion of the helical blade 192 also is present in this coil-receiving portion. A small-diameter circular ring 196 is formed in the upstream end of the coil constituting the toner conveying means 44. The coil extending within the toner conveying passage 36 extends helically from the small-diameter ring 196, and the pitch, outside diameter and winding direction of at least the upstream end portion of this helical coil are made substantially the same as those of the helical blade 192. The coil constituting the toner conveying means 44 is drivingly coupled with the rotating shaft 40 by simply fitting its upstream end portion over the coil-receiving portion of the rotating shaft 40. More specifically, as illustrated in FIG. 16, by causing the small-diameter ring 196 to adjoin the coil-receiving flange 194 formed in the rotating shaft 40 and the upstream end portion of the coil to extend along the helical blade 192 present in the coil-receiving portion, the upstream end portion of the coil is fitted over the coil-receiving portion of the rotating shaft 40. When the rotating shaft 40 is rotated in the direction shown by arrow 42 (clockwise as viewed from left in FIGS. 16 and 17), the force transmitted to the upstream end portion of the coil from the helical vane 192 owing to the friction between them acts in a direction to tension the coil, and therefore, the coil is accurately connected to the rotating shaft 40, and the toner conveying means 44 is rotated in the direction of arrow 42 incident to the rotating shaft 40. The small-diameter ring 196 formed in the upstream end of the coil abuts with the coil-receiving flange 194 formed in the rotating shaft 40, and as a result, accurately prevents the coil from moving upstream along the rotating shaft 40 to the left in FIG. 16.

Figure 18:
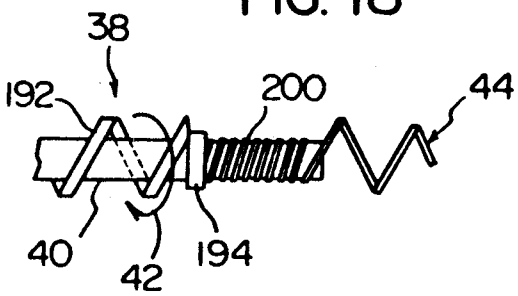
FIG. 18 is a partial top plan view showing a modified examples each of the toner transferring means and the toner conveying means depicted in FIGS. 16 and 17.
Figure 19:
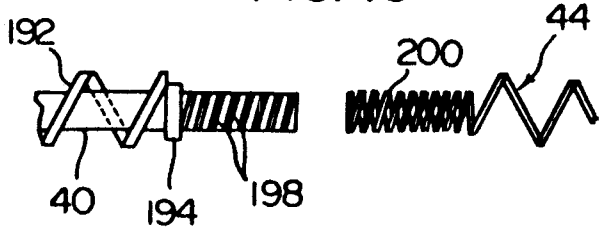
FIG. 19 is a partial exploded top plan view of the toner transferring means and the toner conveying means of FIG. 18.

FIGS. 18 and 19 show modified examples of the mode of drive coupling between the rotating shaft 40 of the toner transferring means 38 and the coil constituting the toner conveying means 44. In these modified examples, the helical blade 192 is formed only up to the coil-receiving flange 194 in the rotating shaft 40, and no helical blade exists in that part of the coil-receiving portion which is right to the coil-receiving flange 194. Preferably, an external thread 198 advancing from left to right while rotating clockwise as viewed from left in FIGS. 18 and 19 is formed in the coil-receiving portion of the rotating shaft 40. On the other hand, a small-diameter linking portion 200 having a smaller diameter than the rest exists in the upstream end portion of the coil constituting the toner conveying means 44. The inside diameter of the small-diameter linking portion 200 may be substantially equal to the outside diameter of the rotating shaft 40. The pitch and winding direction of the small-diameter linking portion 200 are substantially the same as those of the external thread 198. In the modified examples shown in FIGS. 18 and 19, too, the coil constituting the toner conveying means 44 is drivingly coupled with the rotating shaft 40 by simply fitting the small-diameter linking portion 200 existing in its upstream end portion over the coil-receiving portion of the rotating shaft 40. When the rotating shaft 40 is rotated in the direction of arrow 42 (clockwise as viewed from left in FIGS. 16 and 17), the force transmitted to the small-diameter linking portion 200 from the rotating shaft 40 owing to the friction between the two acts in a direction to tension the small-diameter linking portion 200, and therefore, the small-diameter linking portion 200 is accurately linked to the rotating shaft 40, and the coil constituting the toner conveying means 44 is rotated in the direction of arrow 42 incident to the rotating shaft 40. The coil-receiving flange 194 formed in the rotating shaft 40 accurately prevents the small-diameter linking portion 200 of the coil from moving upstream along the rotating shaft 40 to the left in FIG. 18.

Corona discharging device

Figure 20:
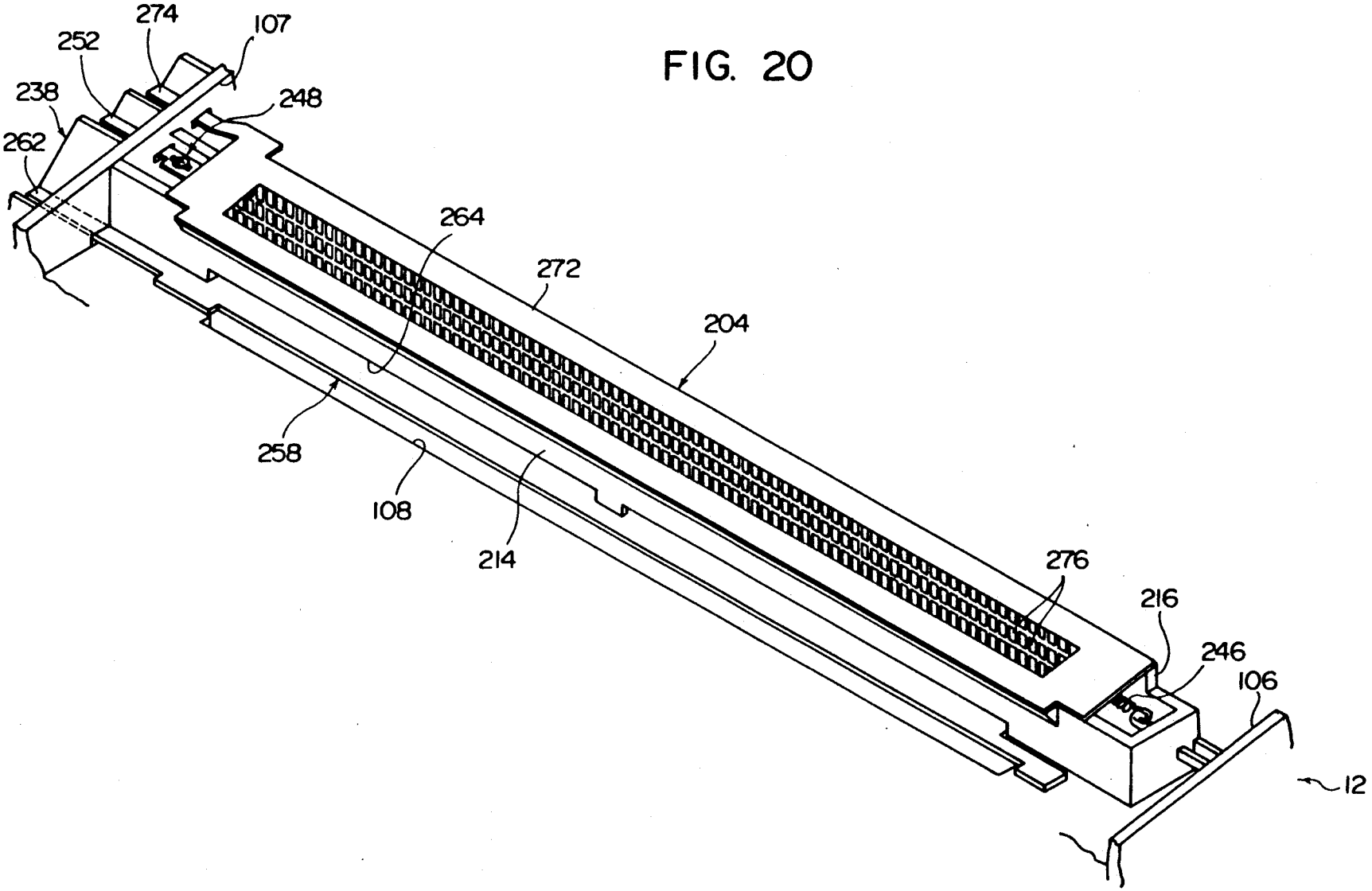
FIG. 20 is a partial perspective view showing a corona discharger in the process units of FIGS. 2 and 3.
Figure 21:
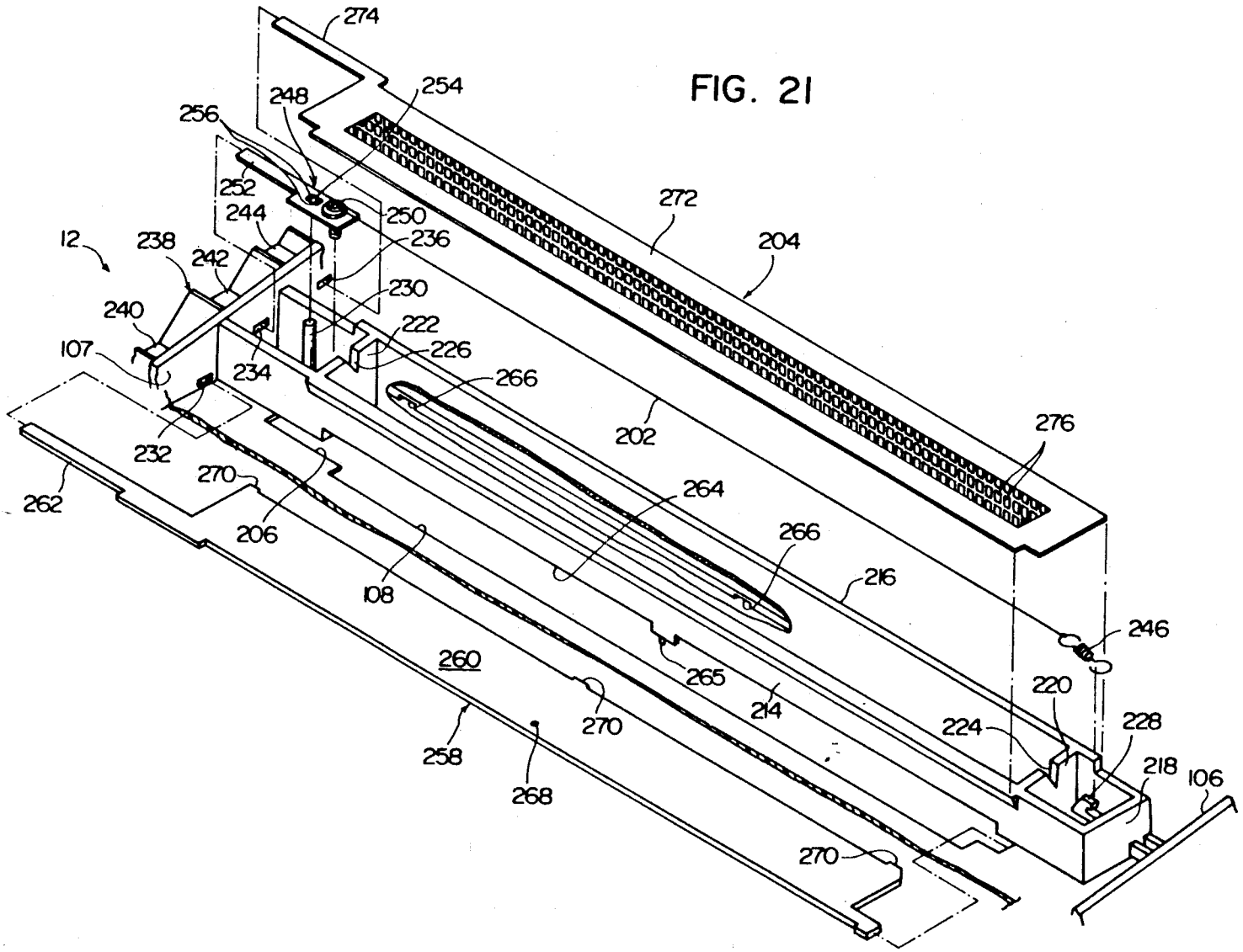
FIG. 21 is an exploded perspective view of the corona discharger of FIG. 20.

With reference to FIGS. 20 and 21 as well as FIGS. 2 and 3, the charging corona discharge 22 improved in accordance with this invention is of the scorotron-type and is equipped with a discharging wire 202 and a grid electrode 204.

As shown in FIGS. 2 and 3, in addition of the exposure opening 108 mentioned above, elongate openings 206 and 208 extending in the width direction are formed in the upper wall 104 of the upper fixed cover member 12 which may be molded from a suitable plastic material. The opening 206 communicates with the exposure opening 108, but extends in the width direction beyond both ends of the exposure opening 108. The opening 208 extends in parallel to the opening 206 with a predetermined distance therebetween. Reinforcing elongate protrusions 210 and 212 extending in the width direction parallel to each other are formed on the elongate upper surface of the wall portion remaining between the openings 206 and 208. As can be understood by reference to FIGS. 3 and 21, where the openings 206 and 208 are formed, downwardly extending walls 214 and 216 are disposed in the upper surface wall 104. These downwardly extending walls 214 and 216 extend parallel to each other from their front ends spaced slightly rearwardly of the front side wall 106 of the upper fixed cover member 12 to the rear side wall 107 of the upper fixed cover member 12. As FIG. 3 shows clearly, the downwardly extending length of the downwardly extending wall 216 is slightly larger than the downwardly extending length of the downwardly extending wall 214. As shown in FIG. 21, a front wall 218 is formed between the front ends of the downwardly extending wall 214 and 216, and at a position spaced a predetermined distance rearwardly of the front wall 218, a wire supporting wall 220 is formed between the downwardly extending walls 214 and 216. A wire supporting wall 222 is also formed between the rear portions of the downwardly extending walls 214 and 216. Cuts 224 and 226 formed in an isosceles triangular shape extending upwardly from the lower end (the upper end in FIG. 21) exist respectively in the wire supporting walls 220 and 222. The front wall 218 has formed therein a projecting piece 228 extending rearwardly from it. The forward end portion of the projecting piece 228 is in the form of a hook. Rearwardly of the wire supporting wall 222, an engaging pillar 230 extending downwardly from the upper surface wall 104 is formed. With reference to FIG. 21, three rectangular slits 232, 234 and 236 are formed in the rear side wall 107 of the upper fixed cover member 12. The slit 234 exists between the downwardly extending walls 214 and 216, and the slits 232 and 236 are positioned adjacent to, and outwardly of, the downwardly extending walls 214 and 216 respectively. A terminal supporting portion 238 is annexed to the rear surface of the rear side wall 107 of the upper cover member 12. In the terminal supporting portion 238 are formed three supporting surfaces 240, 242 and 244 corresponding to the three slits 232, 234 and 236, respectively.

A discharging wire 202 is stretched taut across, and extends parralel to, the downwardly extending walls 214 and 216. With reference to FIG. 21, one end of the wire 202 is connected to the projecting piece 228 via a connecting coil spring 246. Semicircular connecting portions are formed in both surface portions of the connecting coil spring 246. One semicircular connecting portion is connected to one end of the discharging wire 202, and the other semicircular connecting portion is engaged with the hook-like forward end portion of the projecting piece 228. The other end of the discharging wire 202 is connected by means of a set screw 250 to one end portion of a terminal member 248 made of a conductive thin metallic plate. At the other end portion of the terminal member 248 is formed an elongate strip-like input terminal portion 252, and an engaging hole 254 is formed centrally in the terminal member 248. Conveniently, the engaging hole 254 is not formed by completely punching out a thin metallic plate, but is formed such that an engaging protrusion 256 remains. The terminal member 248 to which the other end of the discharging wire 202 is connected is mounted on the engaging pillar 230 by inserting the engaging pillar 230 into the engaging hole 254. An input terminal portion 252 in the terminal member 248 extends through the slit 234 and is positioned on, and supported by, the supporting surface 242. Both end portions of the discharging wire 202 are anchored at the upper ends (lower ends in FIG. 21) of the cuts 224 and 226 of the wire supporting walls 220 and 222, and is thus held at a required position.

The illustrated corona discharger 22 also includes a shield plate 258 formed of a thin conductive metallic plate. The shield plate 258 has a nearly rectangular main portion 260 and an elongate strip-like input terminal portion 262 projecting from one end of the main portion 260. It will be understood by reference to FIGS. 3 and 20 in conjunction with FIG. 21 that the main portion 260 of the shield plate 258 is fixed to a specific site on the inside surface of the upper surface wall 104 of the upper cover member 12 and closes the openings 206 and 208. As is clear from FIG. 3, the exposure opening 108 remains open without being closed by the shield plate 258. As shown in FIG. 21, an elongate receiving opening 264 for insertion of the main portion 260 of the shield plate 258 is formed in the upper end portion of the downwardly extending wall 214, and a protrusion 265 is formed centrally in the receiving opening 264. In the upper end portion of the downwardly extending wall 216, three openings 266 (FIGS. 2 and 21) spaced from each other a suitable distance are formed. A hole 268 corresponding to the protrusion 265 is formed centrally in one side edge of the main portion 260 of the shield plate 258, and three projecting portion 270 corresponding to the three openings 266 are formed in the other side edge of the shield plate 258. The shield plate 258 is held at a predetermined portion by inserting its main portion 260 into the receiving opening 264 to position the projecting portions 270 within the openings 266 and inserting the protrusion 265 in the hole 268. While the main portion 260 of the shield plate 258 is held at a predetermined position as above, the protrusion 265 is deformed or displaced by its own elasticity and the elasticity of the downwardly extending wall 214. The shield plate 258 held at a predetermined portion can be bonded to the upper surface wall 104 of the upper cover member 12 by a both-surface adhesive tape or a suitable adhesive. The input terminal portion 262 of the shield plate 258 extends through the slit 232, and is positioned on, and supported by, the supporting surface 240.

With reference to FIGS. 20 and 21, the grid electrode 204 improved in accordance with this invention has a nearly rectangular main portion 272 and an elongate strip-like input terminal portion 274 projecting from one end of the main portion 272. A number of openings 276 are formed in the main portion 272. The main portion 272 of the grid electrode 204 is positioned astride the free end surfaces (lower end surfaces) of the downwardly extending walls 214 and 216, and extends along, and covers, the discharging wire 202. The main portion 272 of the grid electrode 204 may be fixed to the free end surfaces of the downwardly extending walls 214 and 216 by a both-surface adhesive tape or a suitable adhesive. The input terminal portion 274 of the grid electrode 204 extends through the slit 236 and is positioned on, and supported by, the supporting surface 244. In this illustrated embodiment, the slit 236 and the supporting surface 244 are displaced slightly upwardly (slightly downwardly in FIGS. 20 and 21) from the free end surface of the downwardly extending wall 216. Hence, the input terminal portion 274 is inserted into the slit 236 with its base portion curved slightly upwardly. The grid electrode 204 described above can be formed easily at a low price by press-working a suitable thin metallic plate such as a thin stainless steel plate.

When the upper cover member 12 having the coronas discharger is combined with the other component elements 8, 10 and 14 to construct the process unit 6 and the process unit 6 is moved rearwardly in a direction perpendicular to the sheet surface in FIG. 1 and mounted on a required position of the printer body 4, the input terminal portions 252, 262 and 274 in the corona discharger 22 are fitted in connecting socket portions (not shown) disposed in the printer body 4, and electrical connection is achieved. As a result, a discharge voltage is applied to the discharging wire 202, and the shield plate 258 is grounded. A grid voltage is applied to the grid electrode 204.

While the present invention has been described in detail with reference to specific embodiments of the image-forming machine constructed in accordance with this invention, it should be understood that the invention is not limited to these specific embodiments alone, and various changes and modifications are possible without departing from the scope of the invention.

We claim:

1. An image-forming machine comprising a latent electrostatic image developing device for developing a latent electrostatic image formed on an electrostatographic material, said developing device including a development housing for holding a developer, a developer applicator means for applying the developer in the development housing to the electrostatographic material and a developer agitating means for agitating the developer in the development housing, said developer agitating means having a rotatable shaft adapted to rotate in a rotation direction and an agitating member mounted on the rotatable shaft, the agitating member having a coil spring-shaped mounting portion, and being mounted on the rotatable shaft by elastically increasing the inside diameter of the mounting portion and elastically fitting it over the shaft, the coils of the mounting portion being wound on the shaft such that the agitating member is loosened with respect to the shaft if the agitating member is rotated about the shaft in a direction of rotation that is opposite to the rotation direction of the shaft, wherein the agitating member is disposed on the rotatable shaft such that when a rotation resisting force above a certain limit acts on the agitating member, the agitating member can slip with respect to the rotatable shaft.

2. The image-forming machine of claim 1 in which the agitating member is formed of one continuous metallic wire, and has both end mounting portions axially spaced from each other and mounted on the rotatable shaft, arm portions extending radially from both the end mounting portions respectively, and a main agitation operative portion extending between arm portions.

3. The image-forming machine of claim 2 in which the main agitation operative portion of the agitating member extends substantially parallel to the rotatable shaft.

4. The image-forming machine of claim 2 in which at least two agitating members are mounted on the rotatable shaft, and the main agitation operative portion of one agitating member is larger in a radial distance from the rotating shaft than the main agitation operative portion of the other agitating member.

5. An image-forming machine comprising a latent electrostatic image developing device for developing a latent electrostatic image formed on an electrostatographic material, said developing device including a development housing holding a developer, a developer applicator means for applying the developer in the development housing to the electrostatographic material, and a developer agitating means for agitating the developer in the development housing, said developer agitating means having a rotatable shaft and an agitating member disposed on the rotatable shaft; the rotatable shaft having an eccentric portion for vibrating the agitating member in the radial direction when the shaft is rotated, and the eccentric portion defining a cylinder having an outside diameter when the shaft is rotated, the agitating member having an inside diameter larger than the outside diameter of the rotatable shaft and its eccentric portion, and being idly fitted over the rotatable shaft and the eccentric portion.

6. The image-forming machine of claim 5 in which the agitating member is formed of a coil.

7. The image-forming machine of claim 5 in which the agitating member is formed of a hollow cylindrical body having a plurality of spaced holes formed therein.

8. The image-forming machine of claim 5 in which the eccentric portion is constructed of a crank-like deformed portion.

9. The image-forming machine of claim 5 in which the eccentric portion is constructed of an eccentric cylindrical portion.

10. An image-forming machine comprising a latent electrostatic image developing device for developing a latent electrostatic image formed on an electrostatographic material, said developing device including a development housing holding a developer and a developer applicator means for applying the developer in the development housing to the electrostatographic material, said developer applicator means having a sleeve member for holding the developer on its surface and conveying it and a developer regulating blade means including a blade member adapted to be pressed against the surface of the sleeve member at the inside surface of its free end portion, to regulate the thickness of the layer of the developer conveyed on the surface of the sleeve member, the blade member being formed of a thin plate extending in width direction of the sleeve member and a pressing member which extends in the width direction of the sleeve member and which is disposed on the outside surface of the free end portion of the developer regulating blade via a flexible member extending in the width direction, the pressing member being formed by a thick metallic plate and having a weight such that the pressing member acts on the free end portion of the blade member via the flexible member, whereby the inside surface of the free end portion of the blade member is pressed against the surface of the sleeve member.

11. The image-forming machine of claim 10 in which the developer regulating blade is formed of a thin metallic plate.

12. The image-forming machine of claim 10 in which the flexible member is formed of a foamed synthetic resin.

13. The image-forming machine of claim 10 in which the developer regulating blade means is mounted so that it is free to pivot about an axis extending substantially parallel to the central axis of the sleeve member.

14. The image-forming machine of claim 10 in which the flexible member is fixed to the outside surface of the free end portion of the developer regulating blade and the pressing member is fixed to the outside surface of the flexible member.

15. The image-forming machine of claim 10 in which a permanent magnet is disposed in the sleeve member; the pressing member is formed of magnetic material; and the inside surface of the free end portion of the developer regulating blade is pressed against the surface of the sleeve member by the magnetic attracting force acting on the pressing member owing to the permanent magnet.

16. An image-forming machine comprising a process unit mounted detachably at a predetermined position, said process unit including an electrostatographic material, a cleaning device having a cleaning blade, spring means, and forcing means, and a cover member to be selectively held at a covering position at which it covers part of the electrostatographic material, said cleaning blade in the cleaning device being mounted so as to be free to move between an operative position in which it makes contact with the electrostatographic material and a non-operative position in which it is away from the electrostatographic material, said cleaning device being elastically biased to the operative position by said spring means, said forcing means being disposed such that when the cover member is held at the covering position, said forcing means forces the cleaning blade to the non-operative position against the elastic biasing action of said spring means, said forcing means comprising an engaging means annexed to the cover member and an engaged means annexed to the cleaning blade, when the cover member is held at the covering position, the engaging means acts on the engaged means to force the cleaning blade to the non-operative position.

17. The image-forming machine of claim 16 in which the cover member is detachably mounted on the covering position, and when the cover member is mounted on the covering position, the forcing means forces the cleaning blade to the non-operative position, and when the cover member is removed from the convering position, the spring means biases the cleaning blade elastically to the operative position.

18. The image-forming machine of claim 16 in which the engaging means is constructed of a wedge-shaped protrusion, and the engaged means is formed of an opening which receives the wedge-shaped protrusion.

19. The image-forming machine of claim 16 in which the electrostatographic material is disposed on the peripheral surface of a rotating drum, and the cleaning blade is mounted so that it is free to move between the operative position and the non-operative position roughly in the normal direction of the rotating drum.

20. An image-forming machine comprising a cleaning device for removing the residual toner from an electrostatographic material after a toner image formed on the electrostatographic material is transferred to a receptor material, said cleaning device including a toner removing means for removing the residual toner from the electrostatographic material, a toner recovery housing extending in the width direction along the electrostatographic material for receiving the toner removed from the electrostatographic material by the toner removing means, a toner collecting chamber, a toner conveying passage extending from one end of the toner recovery housing to the toner collecting chamber, a toner transferring means for transferring the toner received in the toner recovery housing to said one end of the toner recovery housing, and a toner conveying means for conveying toner from said one end of the toner recovery housing to the toner collecting chamber through the toner conveying passage, said toner transferring means having a rotatable shaft extending in the toner recovery housing and adapted to be rotated in a predetermined direction, said toner conveying passage being formed of a tubular member having a circular cross section, and said toner conveying means being formed of a coil extending in the toner conveying passage; wherein one end portion of the rotatable shaft has a coil receiving flange formed thereon, and has a coil receiving portion formed between the flange and an end of the shaft, the upstream end portion of the coil, constituting the toner conveying means, being fitted over the coil receiving portion, and the winding direction of the coil being such that when the upstream end portion of the coil is rotated in said predetermined direction incident to the rotation of the rotatable shaft in said predetermined direction, the coil is tensioned.

21. The image-forming machine of claim 20 in which a helical vane extending to the coil receiving portion is formed on the rotating shaft, the pitch of at least the upstream end portion of the coil is substantially the same as the pitch of the helical vane, and the upstream and portion of the coil extends along the helical vane.

22. The image-forming machine of claim 20 in which an external thread is provided in the coil receiving portion of the rotating shaft, the pitch of at least the upstream end portion of the coil is substantially the same as the pitch of the external thread, and the upstream end portion of the coil extends along the external thread.

23. The image-forming machine of claim 20 in which the electrostatographic material is disposed on the peripheral surface of a rotating drum, and the toner collecting chamber is formed within the rotating drum.

24. The image-forming machine of claim 20 in which the electrostatographic material and the cleaning device constitute a process unit to be detachably mounted at a predetermined position.

* * * * *